US010758019B2

(12) United States Patent
Paik et al.

(10) Patent No.: US 10,758,019 B2
(45) Date of Patent: Sep. 1, 2020

(54) FLAP FIXING BUCKLE

(71) Applicant: WOOJIN PLASTIC CO., LTD., Gyeonggi-do (KR)

(72) Inventors: Jisook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD., Guri-si, Gyeonggi-Do (KR)

( * ) Notice: Subject to any disclaimer, the term of this patent is extended or adjusted under 35 U.S.C. 154(b) by 421 days.

(21) Appl. No.: 15/896,528

(22) Filed: Feb. 14, 2018

(65) Prior Publication Data

US 2018/0279736 A1 Oct. 4, 2018

(30) Foreign Application Priority Data

Mar. 30, 2017 (KR) ..... 10-2017-0040696

(51) Int. Cl.

| | |
|---|---|
| ***A45C 3/02*** | (2006.01) |
| ***A45C 13/10*** | (2006.01) |
| ***A44B 11/24*** | (2006.01) |
| ***A44B 11/25*** | (2006.01) |
| ***A44B 11/00*** | (2006.01) |
| ***A44C 5/20*** | (2006.01) |
| ***A45F 3/04*** | (2006.01) |

(52) U.S. Cl.

CPC ..... *A45C 13/1069* (2013.01); *A44B 11/006* (2013.01); *A44B 11/24* (2013.01); *A44B 11/258* (2013.01); *A44C 5/2071* (2013.01); *A45F 3/04* (2013.01); *A44D 2200/10* (2013.01); *A44D 2203/00* (2013.01)

(58) Field of Classification Search

CPC ..... A45C 13/1069; A45C 13/30; A45C 3/02; A44B 11/24

USPC ..... 24/302, 303, 307; 150/118; 190/902

See application file for complete search history.

(56) References Cited

U.S. PATENT DOCUMENTS

| | | | | |
|---|---|---|---|---|
| 2,822,847 A * | 2/1958 | Cesaroni, Jr. | ..... | A45C 9/00 190/1 |
| 4,913,283 A * | 4/1990 | Stuhn | ..... | A45C 3/00 190/124 |
| 9,307,808 B1 * | 4/2016 | Lill | ..... | A44B 11/2584 |

(Continued)

FOREIGN PATENT DOCUMENTS

| | | |
|---|---|---|
| KR | 20-0216902 | 3/2001 |
| KR | 20-2001-0000532 | 5/2013 |

*Primary Examiner* — Sue A Weaver

(74) *Attorney, Agent, or Firm* — Novick, Kim & Lee, PLLC; Jae Youn Kim

(57) ABSTRACT

The present disclosure relates to a flap fixing buckle including: a plug member having a cross bar that transverses an intermediate portion of a loop-shaped frame, in which a coupling protruding portion in which a magnet is embedded protrudes from the cross bar; and a socket member having a coupling groove into which the coupling protruding portion is inserted and which is formed in an upper surface of the socket member, in which a magnet is embedded inside the coupling groove, and a wing portion extends at the periphery of the upper surface of the socket member, and as a result, when the flap fixing buckle is installed on a bag or the like, an aesthetic external appearance may be formed because of a simple configuration, and the flap fixing buckle may be stably and conveniently fastened.

17 Claims, 19 Drawing Sheets

(56) References Cited

U.S. PATENT DOCUMENTS

| | | | | |
|---|---|---|---|---|
| 9,585,445 | B2 * | 3/2017 | Qian | A44C 5/2052 |
| 2016/0058147 | A1 * | 3/2016 | Bemis | H01F 7/0263 206/45.2 |

* cited by examiner (a)

(b)

FLAP FIXING BUCKLE

CROSS-REFERENCE TO RELATED APPLICATIONS

This application is based on and claims priority from Korean Patent Application No. 10-2017-0040696, filed on Mar. 30, 2017, with the Korean Intellectual Property Office, the disclosure of which is incorporated herein in its entirety by reference.

TECHNICAL FIELD

The present disclosure relates to a flap fixing buckle, and more particularly, to a flap fixing buckle capable of allowing a flap for covering an opening of a bag, a backpack, or a knapsack to be conveniently fixed, and capable of providing an aesthetic external appearance that is simply organized.

BACKGROUND

In general, various types of bags or cases such as bags, knapsacks, backpacks, handbags, mobile phone cases, and jotter cases (hereinafter, referred to as a 'bag') are each provided with an accommodation space therein, an opening which communicates with the outside, and a means for opening and closing the opening.

Among others, a bag, which is provided with a flap for covering an opening, is also widely used. A fastening means is installed at a free end of the flap so as to be attached to or detached from a bag body, such that the opening of the bag is closed or opened by fixing or separating the flap.

Patent Documents 1 and 2 disclose that magnets are provided on corresponding surfaces of the free end of the flap and the bag body so that the flap is attached to the bag body by coupling the magnets. The configuration in which the flap and the bag body are attached to each other by means of the magnets as described above is applied to and used for various accommodating structures such as jotter cases or mobile phone cases as well as the bag.

While a small-sized bag such as a handbag or a mobile phone case has a fixed size, a larger bag such as a backpack or a knapsack requires a long fixing means to correspond to the amount of items accommodated therein. To this end, a strap is provided on the flap, a magnet is provided on the strap, and a buckle of which the position is adjustable is provided on the strap so that a length of the strap may be adjusted.

FIG. 1 illustrates an example of a bag provided with a flap in the related art. As illustrated in FIG. 1, a flap F for opening and closing an opening of a bag B is openably and closably provided on an upper end portion of the bag B, and straps S1 are provided on the flap F and extend to the outside from the flap F. Buckles 1 are provided at free ends of the straps S1 so as to be fixed to or separated from a bag body B.

There is applied a fastening structure in which multiple holes are formed in the strap S1 so that the strap S1 is coupled to the buckle 1 having a hook and a position is adjusted as the hook is coupled to or decoupled from the hole, and as a result, a range to be covered by the flap F may be adjusted, and a magnet is attached to the buckle so that the buckle may be conveniently fastened and separated.

The combination of the strap and the buckle having the hook provides a decorative effect by itself and is substantially intended to provide a convenient manipulation by means of attachment and detachment of the magnet.

FIG. 2 is a photograph specifically illustrating an example of a bag in the related art in which a strap of a flap is fastened by a magnet, and FIG. 3 is a partial side view illustrating a state in which the strap and a buckle illustrated in the FIG. 2 are coupled to a bag body. As illustrated in FIGS. 2 and 3, a first magnet 11 is embedded in the bag body B, and a buckle 1 of which the position is adjustable is provided on the strap S extending from the flap F.

An auxiliary strap S-1 is connected to the buckle 1, and a second magnet 21 is provided at an end portion of the auxiliary strap S-1 so that the second magnet 21 is attached to or detached from the first magnet 11 provided on the bag body B.

Any one of the first magnet 11 and the second magnet 21 may be made of metal.

The flap fastening structure of the bag in the related art has the following problems.

1. The dual structure includes the strap S which is fastened to the buckle 1, and the auxiliary strap S-1 which is connected to the buckle 1 and attached to or detached from the bag body B, and as a result, the dual structure is very complicated, such that there occurs a defect in an external appearance of the bag.
2. The protruding complicated straps and the protruding buckle easily collide with outside objects, and as a result, there is a problem in that the straps and the buckle are easily separated.
3. Because of a number of subsidiary elements, there is a problem in that costs are increased, it is difficult to manufacture the product, and a process is complicated.
4. It is necessary to necessarily separate the auxiliary strap positioned below the strap in order to disassemble the flap. That is, it is necessary to perform an inconvenient operation of lifting up the strap S and holding the magnet of the auxiliary strap S-1 to separate the magnet.
5. Because the attached magnet is exposed, there is concern that the magnet is likely to be damaged due to external impact.
6. There is a problem in that it is difficult to adjust the strap in accordance with a volume of the bag, and the attached magnet is easily separated and lost as the bag is used.

Therefore, to solve the aforementioned problems, there is a need for a flap fixing buckle capable of providing an organized external appearance and capable of being more conveniently used.

DOCUMENTS OF RELATED ART

Patent Documents

1. Korean Utility Model Application Laid-Open No. 2001-0000532 (Jan. 5, 2001)
2. Korean Utility Model Registration No. 20-0216902 (Jan. 4, 2001)

SUMMARY

The present disclosure has been made in an effort to provide a flap fixing buckle which has a non-complicated external appearance and may be conveniently used.

The present disclosure has also been made in an effort to provide a flap fixing buckle which may maintain stable engagement of the buckle regardless of external contact and may prevent the magnet from being damaged by external impact.

The present disclosure has also been made in an effort to provide a flap fixing buckle capable of providing a simple structure that allow the buckle to be easily manufactured and reduces costs.

An exemplary embodiment of the present disclosure provides a flap fixing buckle including: a plug member having a cross bar that transverses an intermediate portion of a loop-shaped frame, in which a coupling protruding portion in which a first magnet is embedded protrudes from the cross bar; and a socket member having a coupling groove into which the coupling protruding portion is inserted and which is formed in an upper surface of the socket member, in which a second magnet is embedded inside the coupling groove.

Another exemplary embodiment of the present disclosure provides a flap fixing buckle including: catching grooves may be formed in lateral surfaces of the coupling protruding portion, protruding portions may protrude from a circumferential edge portion of the coupling groove so as to face one another, and catching protrusions may be formed on lateral surfaces of the protruding portions which face one another, such that the catching protrusions are coupled to the catching grooves when the coupling protruding portion is inserted into the coupling groove.

Another exemplary embodiment of the present disclosure provides a flap fixing buckle including: a plug member having a cross bar that transverses an intermediate portion of a loop-shaped frame, in which a coupling protruding portion in which a first magnet is embedded protrudes from the cross bar; and a socket member having multiple guide protruding portions that protrude from an upper surface of the socket member such that a coupling groove into which the coupling protruding portion is inserted is formed between the guide protruding portions, in which a second magnet is embedded inside the coupling groove.

Four guide protruding portions may be formed to face one another so that a "+" shaped groove is formed between the guide protruding portions.

Further, catching protrusions may be formed inside the guide protruding portions, and catching grooves, which are coupled to the catching protrusions, may be formed in lateral surfaces of the coupling protruding portion.

A strap, which is installed on a flap of a bag and has holes formed at predetermined intervals, may be inserted into the frame, and a hook may be rotatably coupled to an intermediate portion of the cross bar and inserted into the hole of the strap, such that the strap and the plug member are coupled to each other, and the socket member may be attached and installed at one end of a bag body in a state in which the socket member is embedded so that the coupling groove is exposed to the outside, such that the plug member and the socket member are attached by magnetic force.

The frame may be formed such that lower ends of the intermediate portion, which face each other, protrude and extend downward, and the cross bar may be formed on the protruding portions.

The socket member may be attached and installed at one end of a bag body in a state in which the socket member is embedded so that the coupling groove is exposed to the outside.

The socket member is coupled at one end of the bag body by sewing or adhesion.

A circumferential edge portion of the socket member may further extend outward to form a wing portion, such that the socket member is easily attached to the bag body.

A hook groove may be formed in the intermediate portion of the coupling groove so as to intersect the intermediate portion of the coupling groove, such that the hook is accommodated in the hook groove when the coupling protruding portion is coupled.

Still another exemplary embodiment of the present disclosure provides A flap fixing buckle including: a bag body; a flap which is configured to open and close an opening of the bag body and has a strap installed at a tip portion thereof; a plug member having a cross bar that transverses an intermediate portion of a loop-shaped frame, in which the strap is inserted into the plug member so as to be fixed by a hook or separated, and a coupling protruding portion in which a first magnet is embedded protrudes from the cross bar; and a socket member having a coupling groove into which the coupling protruding portion is inserted and which is formed in an upper surface of the socket member, in which a second magnet is embedded inside the coupling groove, and a wing portion extends at the periphery of the upper surface of the socket member, such that the wing portion is fixedly attached to one end of the bag body.

According to the flap fixing buckle according to the present disclosure, there is provided the simplified structure that includes the plug member which has the cross bar on which the coupling protruding portions are formed, and the socket member which is fixedly embedded in the bag body and has the coupling groove into which the coupling protruding portions are coupled. Therefore, it is possible to form an aesthetic external appearance that is not complicated, and to provide convenience by allowing the flap fixing buckle to be attached or detached by a simple operation.

According to the flap fixing buckle according to the present disclosure, the magnet is safely embedded without being exposed to the outside, thereby providing stability since the magnet is not easily separated or damaged due to external contact or impact.

According to the flap fixing buckle according to the present disclosure, costs may be reduced and effective productivity may be provided because of the simple configuration.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
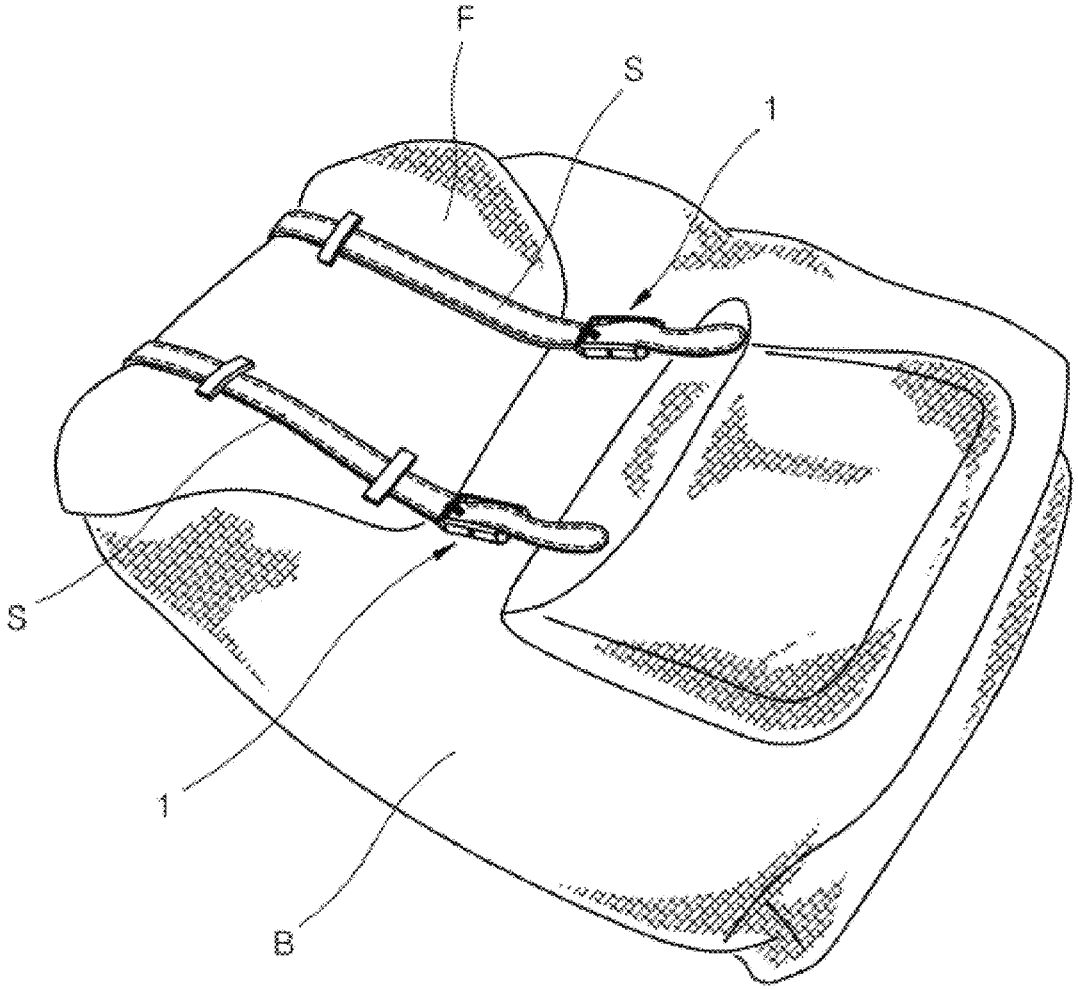
FIG. 1 is a view of an exemplary embodiment of a general bag having a flap and straps.
Figure 2:
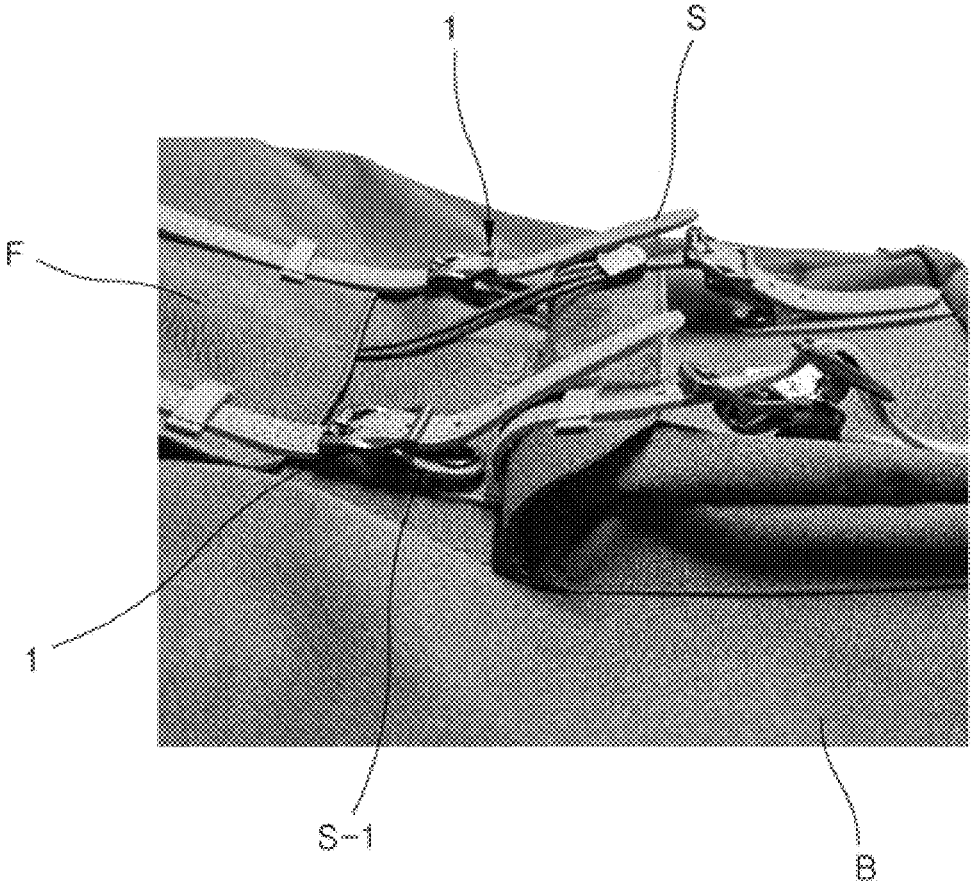
FIG. 2 is a partial photograph illustrating an example of the straps provided on the flap of the bag in the related art.
Figure 3:
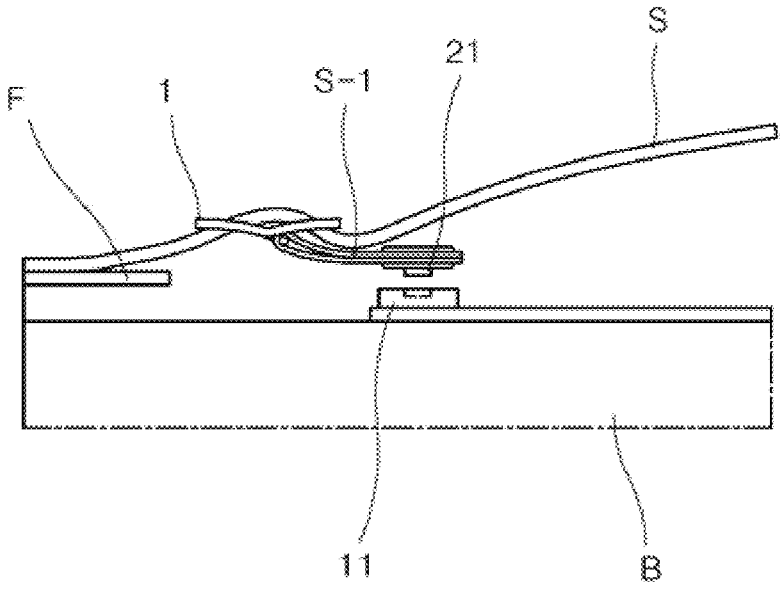
FIG. 3 is a partial side view illustrating a state in which the strap illustrated in FIG. 2 is installed.

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, specific contents of the present disclosure will be described in detail with reference to the accompanying drawings. Here, thicknesses of lines illustrated in the drawings, sizes of constituent elements, or the like may be exaggerated for clarity and convenience of description.

The terms used in the following description are defined considering the functions in the present disclosure and may vary depending on the intention or usual practice of a user or an operator. Therefore, the definition of the terms should be made based on the entire contents of the present specification.

FIGS. 4 to 8 illustrate a first exemplary embodiment of the present disclosure.

Figure 4:
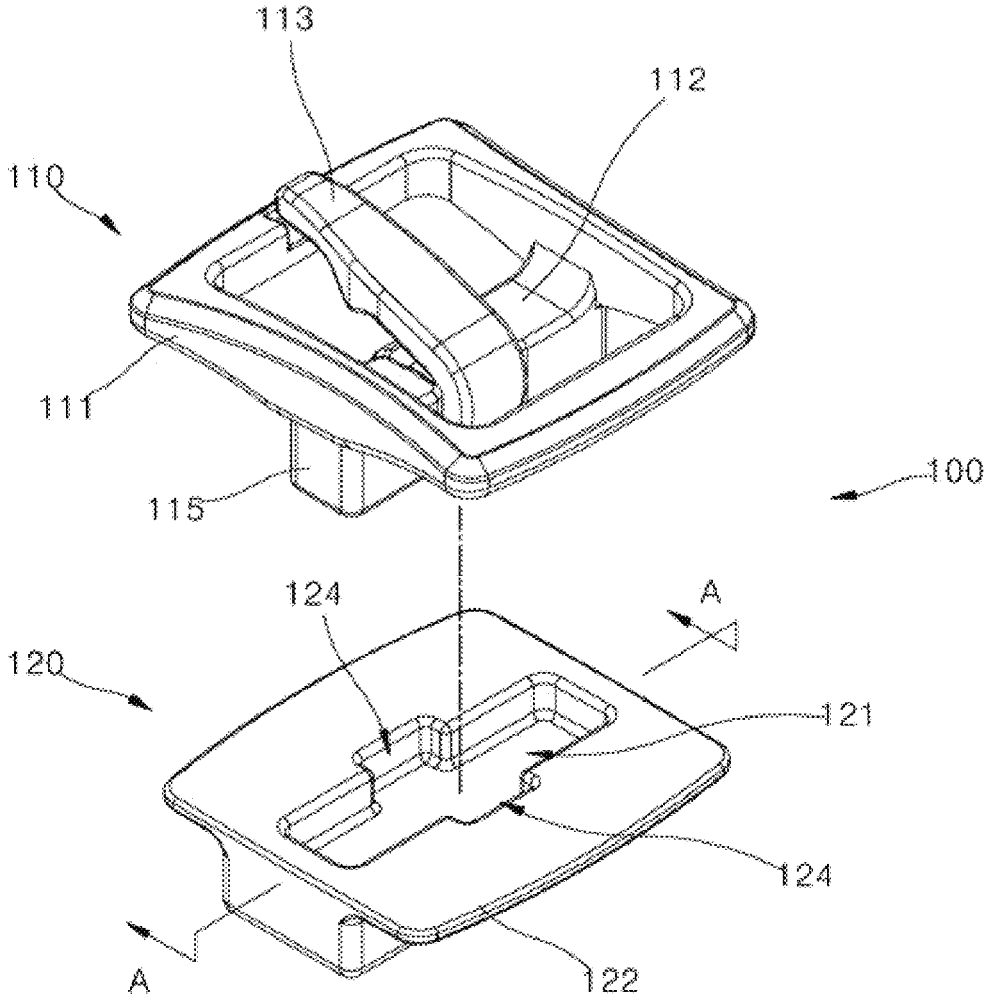
FIG. 4 is a perspective view illustrating a state in which a plug member and a socket member of a buckle according to the present disclosure correspond to each other.
Figure 5:
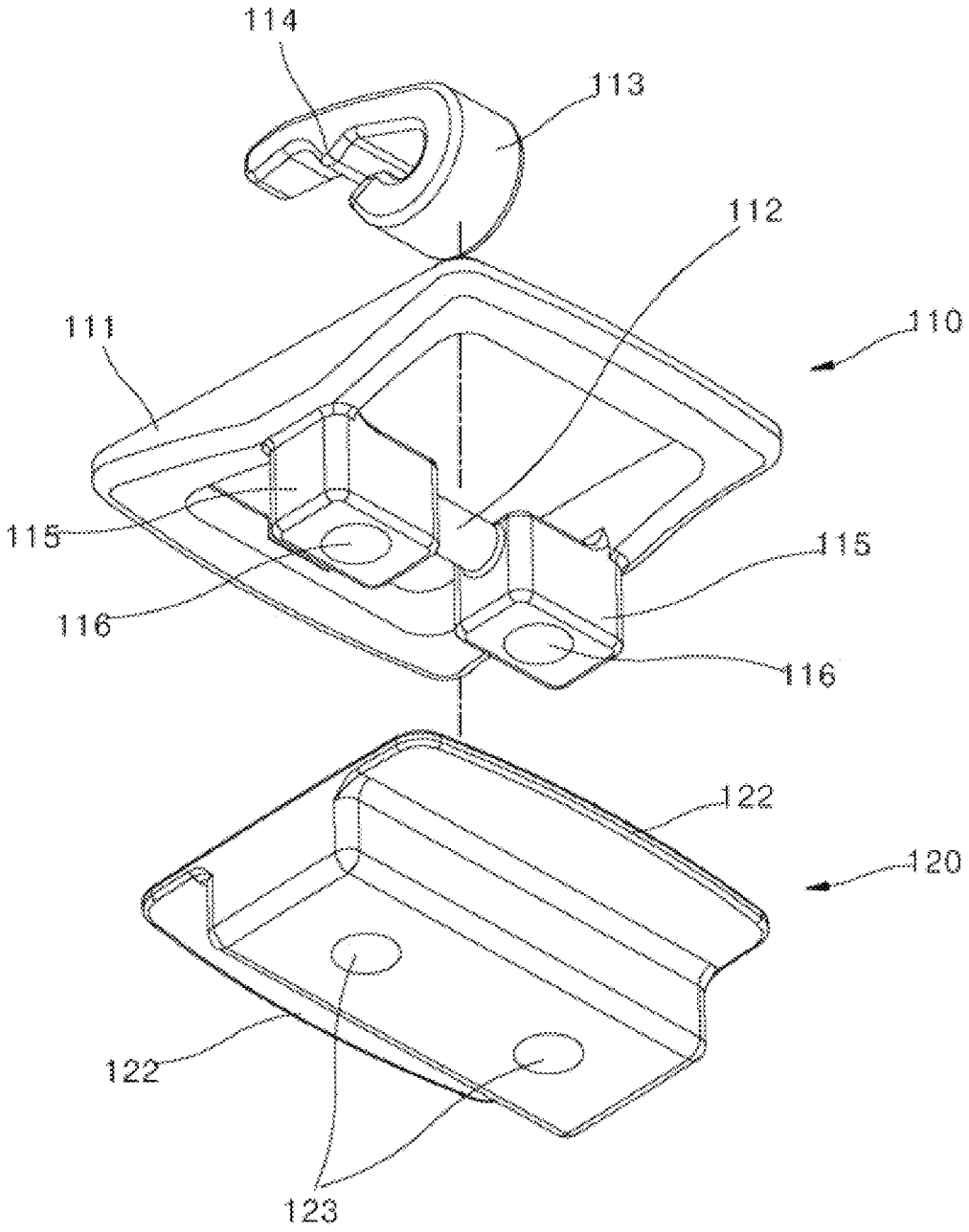
FIG. 5 is an exploded bottom perspective view of the buckle according to the present disclosure.
Figure 6:
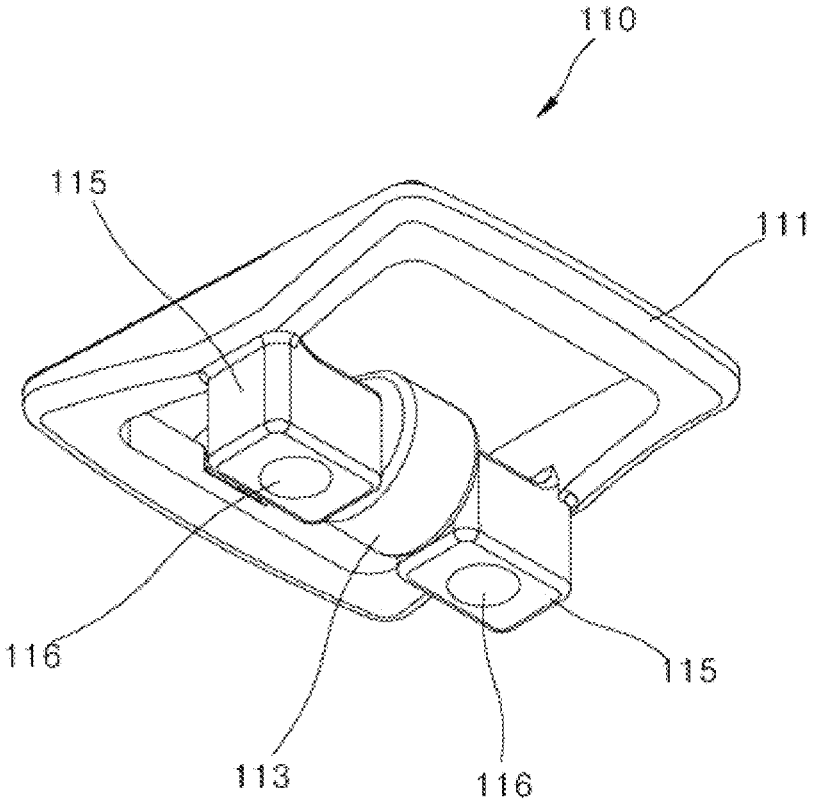
FIG. 6 is a bottom perspective view of the plug member according to the present disclosure.
Figure 7:
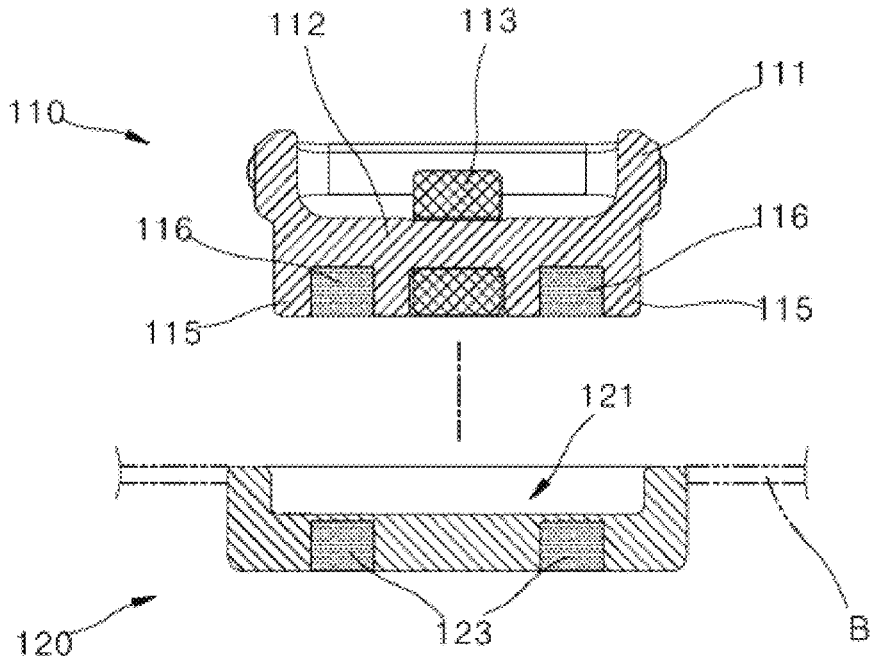
FIG. 7 is a view illustrating a coupled state in a cross section taken along line A-A in FIG. 4.
Figure 7:
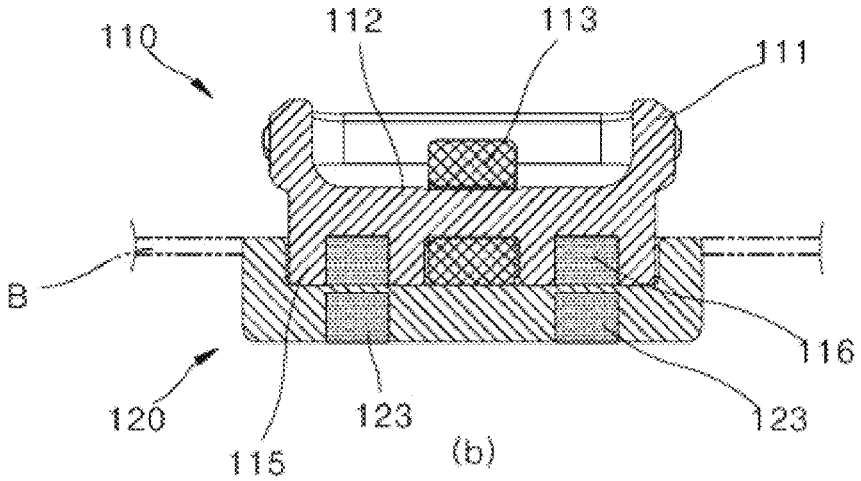

FIG. 4 is a perspective view illustrating a state in which a plug member and a socket member of a buckle according to the present disclosure correspond to each other, FIG. 5 is an exploded bottom perspective view of the buckle according to the present disclosure, FIG. 6 is a bottom perspective view of the plug member according to the present disclosure, and FIG. 7 is a view illustrating a coupled state in a cross section taken along line A-A in FIG. 4. As illustrated in FIGS. 4 to 7, a buckle 100 according to the present disclosure basically and broadly includes a plug member 110 and a socket member 120.

The plug member 110 includes a frame 111 which has a loop shape, a cross bar 112 which traverses a lower intermediate side of the frame 111, and a hook 113 which is coupled to an intermediate portion of the cross bar 112.

The frame 111 is illustrated in the drawings as having a quadrangular loop shape, but the shape of the frame 111 is just optional.

Figure 8:
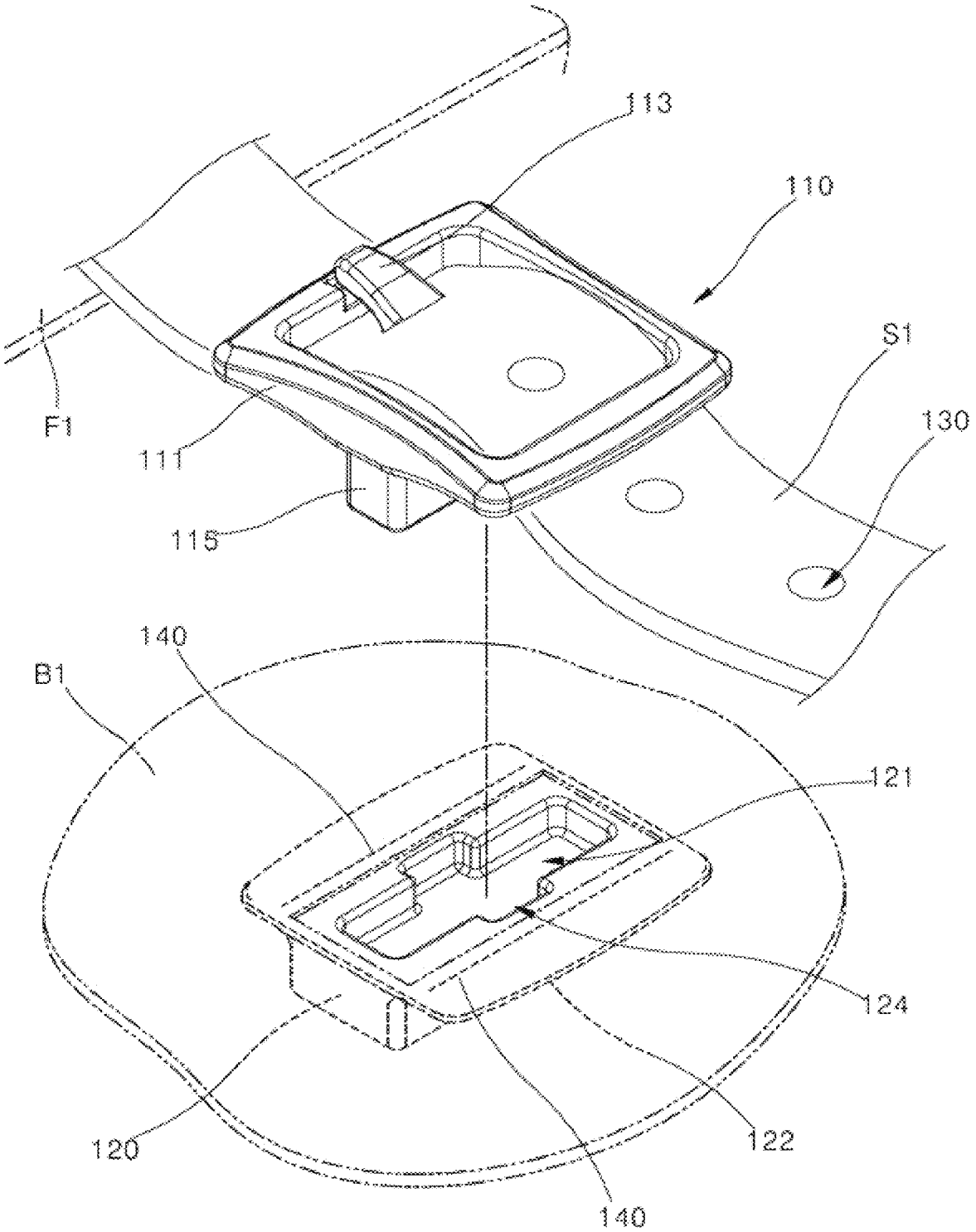
FIG. 8 is a view illustrating a state in which the buckle according to the present disclosure is installed.

A strap is interposed between the frame 111 and the cross bar 112. As illustrated in FIG. 8, a strap S1 enters the frame 111 from a lower side of the frame 111, travels over an upper side of the cross bar 112, and exits the frame 111 from an opposite lower side of the frame. Central portions of lateral portions of the frame 111 extend downward and the cross bar 112 is formed at lower ends of the central portions so that the strap may be smoothly interposed, and as a result, the cross bar 112 is positioned to further protrude downward in comparison with a circumferential edge portion of the frame 111.

Coupling protruding portions 115 are formed at both sides of the cross bar 112. The coupling protruding portion 115 may have a quadrangular cross section, and a first magnet 116 is embedded in a lower surface of the coupling protruding portion 115.

A recessed portion is formed in the intermediate portion of the cross bar 112 as the coupling protruding portions 115 are formed at both sides, and the hook 113 is installed in the recessed portion.

The hook 113 is fitted to be wound around the cross bar 112 so that the hook 113 is rotated about the cross bar 112. A tip portion of the hook 113 is elongated and inserted into a hole 130 formed in the strap S1, such that the hook 113 is fastened to the strap S1.

A catching projection 114 is formed at an intermediate portion of the hook 113. When the hook 113 is inserted into the hole 130 of the strap S1, the catching projection 114 prevents the tip portion of the hook 113 from excessively protruding while penetrating the strap S1.

The socket member 120 is formed in a thin plate shape, and a coupling groove 121 into which the coupling protruding portions 115 are inserted is formed in an upper surface of the socket member 120. A second magnet 123 is embedded in a bottom surface of the coupling groove 121.

As illustrated in FIG. 7, the plug member 110 and the socket member 120 remain coupled by magnetic force as the coupling protruding portions 115 of the plug member 110 are inserted into the coupling groove 121 of the socket member 120.

The socket member 120 is embedded at one end of a bag body B1. To this end, a circumferential edge portion of the upper surface of the socket member 120 extends outward such that a wing portion 122 may be formed. The wing portion 122 is attached to an outer sheath that defines the bag body B1.

As illustrated in FIG. 8, the wing portion 122 of the socket member 120 is coupled, by sewing, to the outer sheath of the bag body B1 in a state in which the coupling groove 121 is exposed. Alternatively, the wing portion 122 may be fixedly attached by a bonding agent. Reference numeral '140' indicates a sewed line.

A hook groove 124, which extends toward both sides, is formed in an intermediate portion of the coupling groove 121, thereby ensuring a space which may accommodate the hook 113 that protrudes laterally when the coupling protruding portions 115 are inserted.

The movements of the coupling protruding portions 115 are prevented as the hook 113, which further protrudes laterally than the coupling protruding portions 115, is coupled to the hook groove 124 when the coupling protruding portions 115 and the hook 113 are coupled, such that a larger contact area is ensured, thereby maintaining a more stably coupled state.

That is, when an unintentional action, such as external contact, of separating the buckle occurs, a simple coupled state of the coupling groove 121 and a coupled state of the hook groove 124, which intersects the coupling groove 121, complexly act, thereby preventing abnormal withdrawal of the plug member 110.

In the present disclosure configured as described above, the socket member 120 is embedded at one end of the bag body B1, the strap S1 connected to the flap F1 is inserted into the frame 111 of the plug member 110, and the hook 113 is inserted into and connected to the hole 130.

The multiple holes 130 are formed at predetermined intervals in the strap S1, and as a result, it is possible to adjust a position of the plug member 110 by changing, as necessary, the position at which the hook 113 is coupled to the hole 130.

FIG. 7A is a cross-sectional view illustrating a state in which the plug member 110 and the socket member 120 are separated from each other, and FIG. 7B is a cross-sectional view of a coupled state. As described above, the buckle according to the present disclosure is coupled as the plug member 110 provided on the strap S1 is directly coupled to the socket member 120. The plug member 110 and the socket member 120 are strongly attached and coupled to each other by magnetic force of the first and second magnets 116 and 123 as the coupling protruding portions 115 of the plug member 110 are inserted into the coupling groove 121 of the socket member 120.

The coupling protruding portions 115 of the plug member 110 are attracted and inserted into the coupling groove 121 by strong magnetic force of the first and second magnets 116 and 123 even when the plug member 110 approaches the vicinity of the socket member 120.

To separate the plug member 110 and the socket member 120, the buckle is separated as the coupling protruding portions 115 are withdrawn from the coupling groove 121 only by lifting up a free end of the strap S1 by applying small force, that is, force greater than attachment force of the first and second magnets 116 and 123.

As described above, the buckle is simply separated by lifting the plug member 110 directly upward with respect to the socket member 120 by using the tip portion of the strap S1. However, in a case in which pressure is applied in an abnormal direction, that is, in a lateral direction due to external contact, the buckle is not easily separated since the coupling protruding portions 115 are inserted into the coupling groove 121. Further, the hook groove 124 is formed to intersect the intermediate portion of the coupling groove 121, and multiple surfaces are connected to one another as the hook 113 is coupled to the hook groove 124, and as a result, the plug member and the socket member are not easily separated in the directions other than the directly upward direction.

Figure 9:
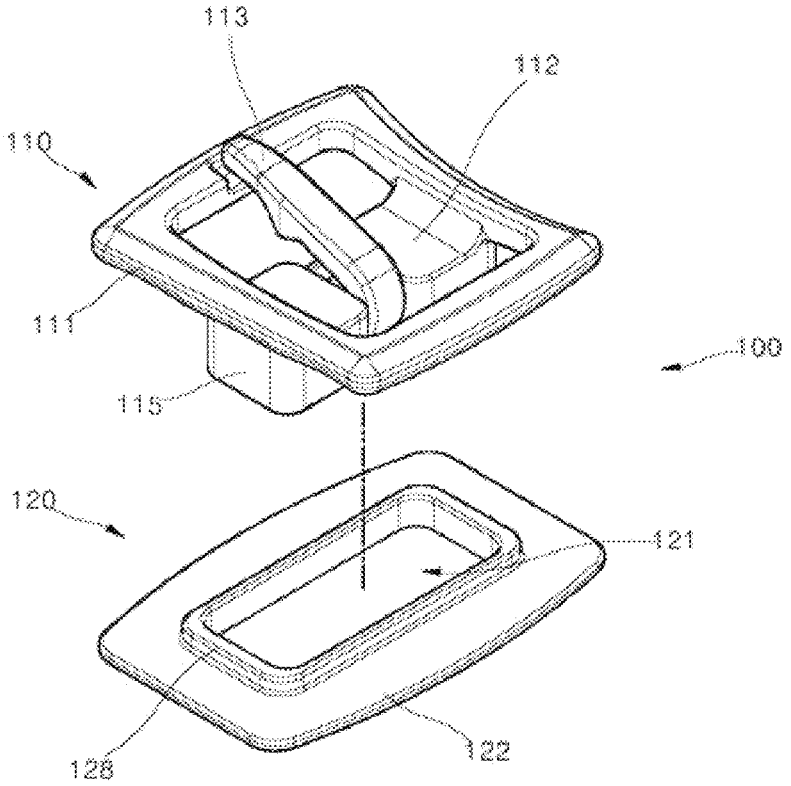
FIG. 9 is a perspective view illustrating a state in which a plug member and a socket member of another type of buckle according to the present disclosure correspond to each other.
Figure 10:
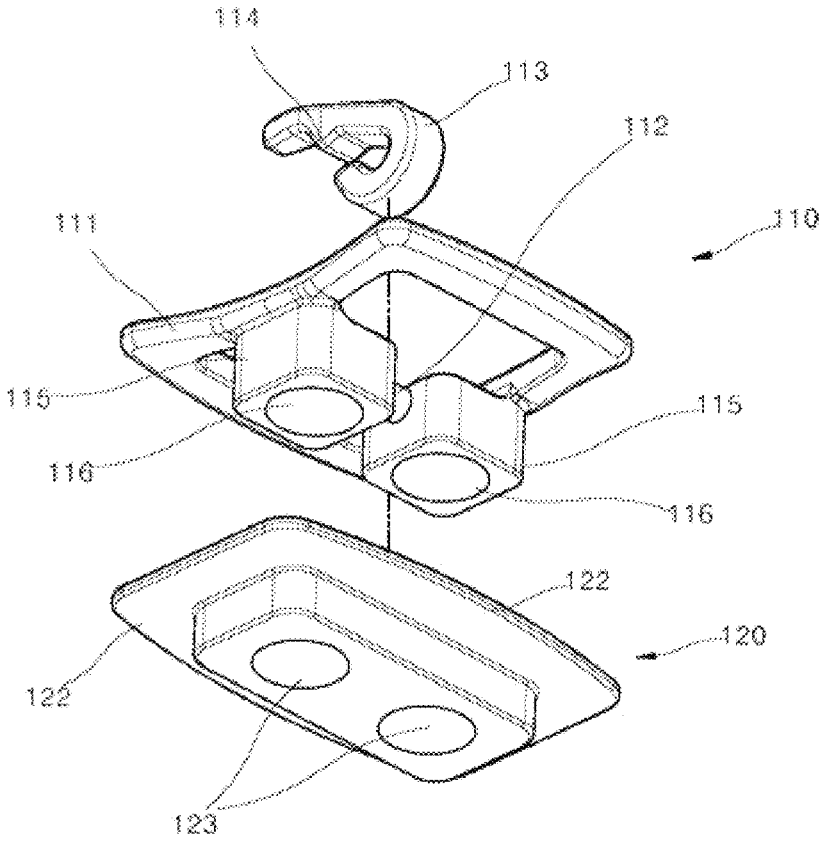
FIG. 10 is an exploded bottom perspective view of FIG. 9.
Figure 11:
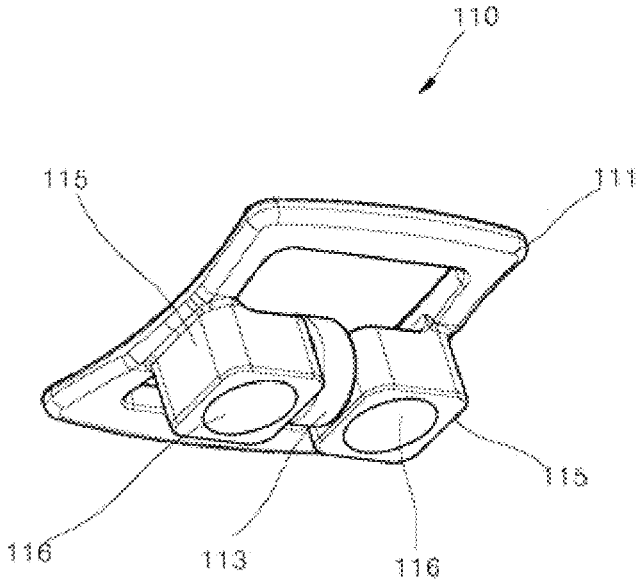
FIG. 11 is a bottom perspective view of the plug member illustrated in FIG. 9.

FIG. 9 is a perspective view illustrating a state in which a plug member and a socket member of another type of buckle according to the present disclosure correspond to each other, FIG. 10 is an exploded bottom perspective view of FIG. 9, and FIG. 11 is a bottom perspective view of the plug member illustrated in FIG. 9. Referring to FIGS. 9 to 11, the outer circumferential edge of the hook 113 does not protrude outward from the coupling protruding portions 115 when the hook 113 is fitted with the cross bar 112. Therefore, the coupling groove 121 of the socket member 120, which accommodates the coupling protruding portions 115, may be organized in a simpler form, and the hook groove 124 described in the exemplary embodiment may not be provided.

In addition, a circumferential edge portion 128 is formed to protrude at an outer circumferential edge of the coupling groove 121 of the socket member 120, such that the outer sheath of the bag is organized so as not to move over the coupling groove 121 when the wing portion 122 is installed in the outer sheath of the bag, and as a result, the operation may be easily and accurately performed.

Figure 12:
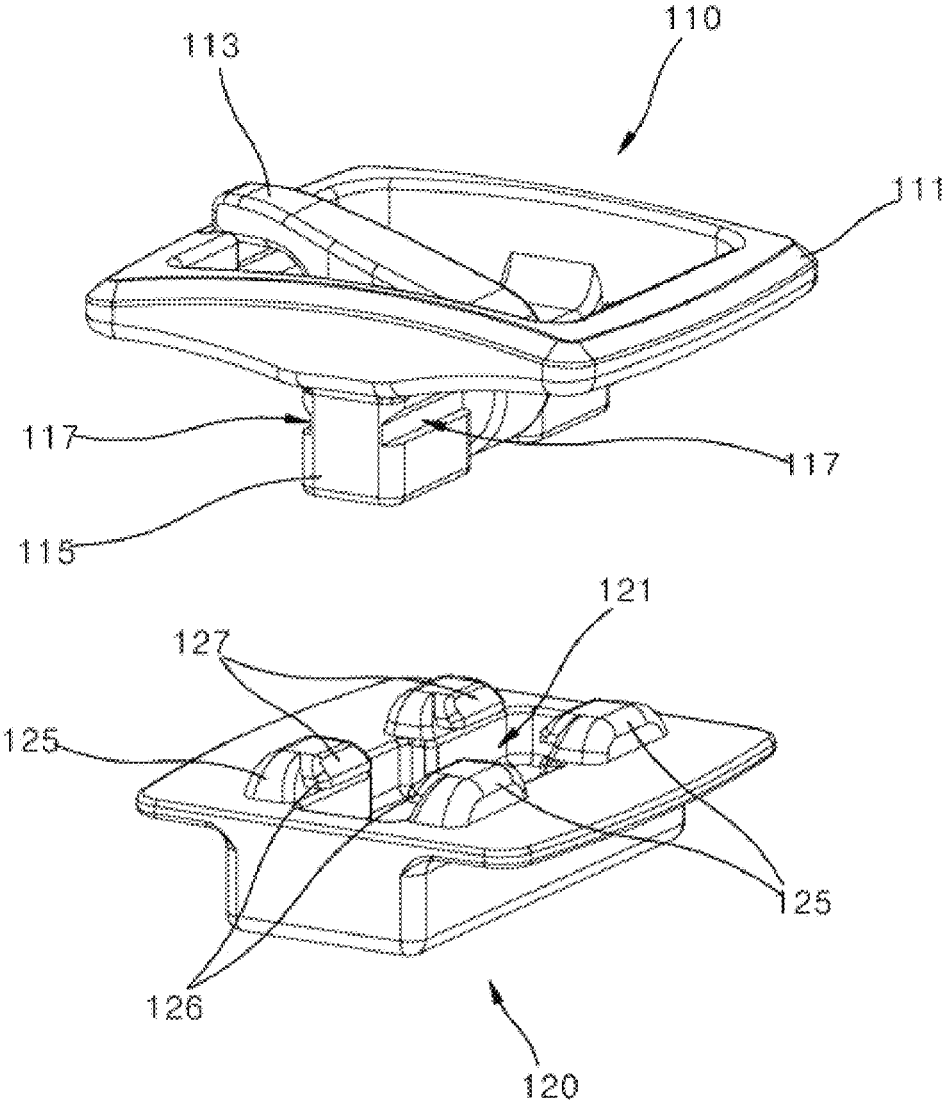
FIG. 12 is an exploded perspective view illustrating still another type of buckle according to the present disclosure.
Figure 13:
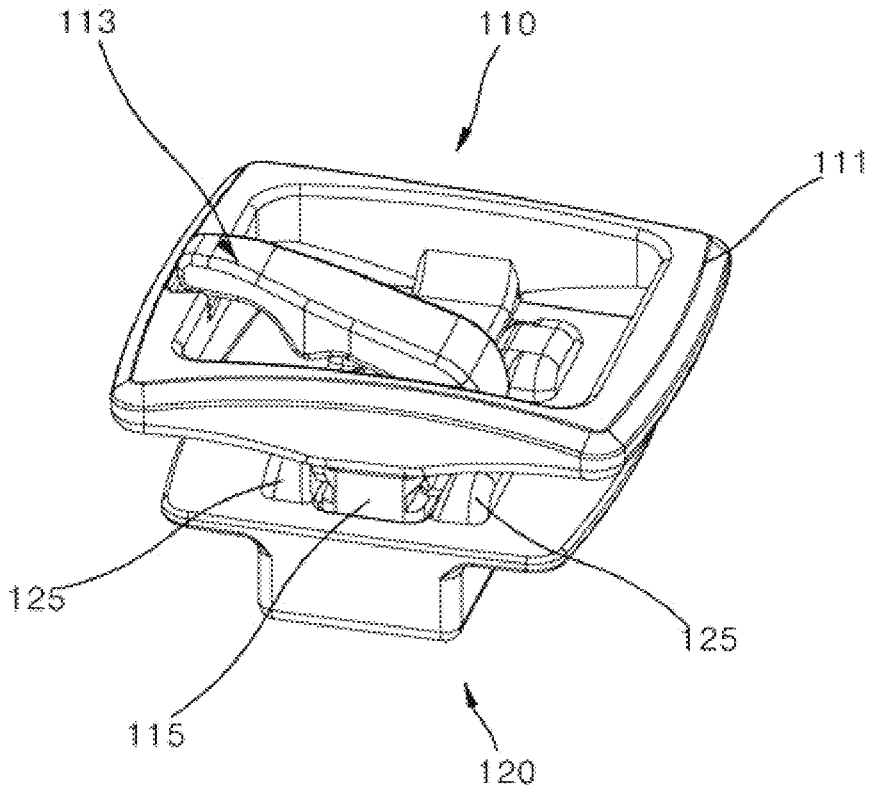
FIG. 13 is a perspective view illustrating a coupled state of FIG. 12.

FIG. 12 is an exploded perspective view illustrating a modified example of the buckle according to the present exemplary embodiment, and FIG. 13 is a coupled perspective view thereof. Referring to FIGS. 12 and 13, catching grooves 117 are formed in lateral surfaces of the coupling protruding portions 115 of the plug member 110, protruding portions 125 are formed so as to face one another at both sides of the coupling groove 121 of the socket member 120, and catching protrusions 126 protrude from inner surfaces of the protruding portions 125 so as to face one another.

Therefore, when the coupling protruding portions 115 are inserted into the coupling groove 121, the catching protrusions 126 are caught by the catching grooves 117 of the coupling protruding portions 115 while the coupling protruding portions 115 are strongly inserted by magnetic force of the magnets, and as a result, the coupled state of the plug member 110 and the socket member 120 may be more securely maintained by magnetic force of the magnets.

An inclined surface 127 is formed on an upper surface of each of the catching protrusions 126 so that the coupling protruding portion 115 may be more easily inserted, and a curved or inclined surface may also be formed at an upper or lower end of the catching groove 117 so that the catching protrusion 126 is smoothly connected.

The coupling protruding portions 115 may be easily inserted into the coupling groove 121 by magnetic force while being guided by the inclined surfaces 127, and the plug member 110 may be separated from the socket member 120 by applying small force.

The catching protrusion 126 may also be formed on an inner surface of the coupling groove 121.

According to the exemplary embodiment of the present disclosure as described above, a stably coupled state of the plug member 110 and the socket member 120 may be maintained, and the intended separation may be conveniently performed.

FIGS. 14 to 19 illustrate a second exemplary embodiment of the present disclosure.

Figure 14:
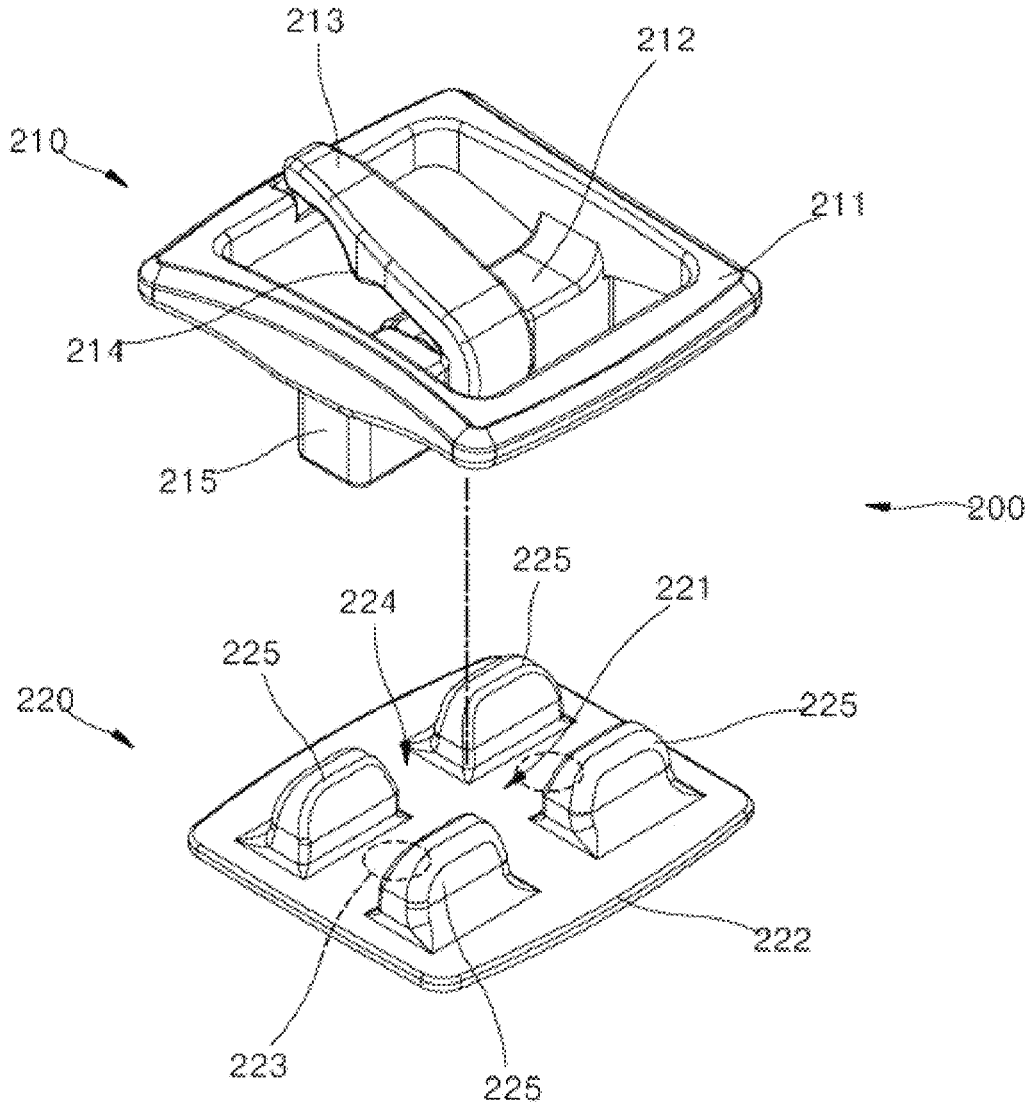
FIG. 14 is a perspective view of a buckle according to a second exemplary embodiment of the present disclosure.
Figure 15:
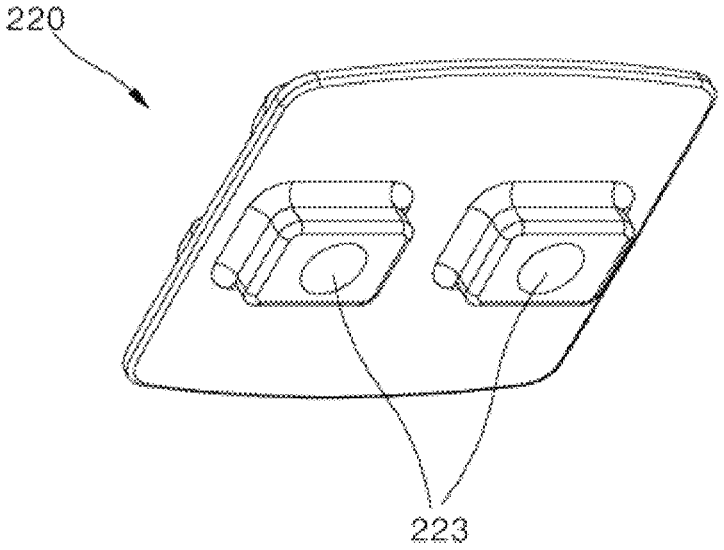
FIG. 15 is a bottom perspective view of a socket member according to the second exemplary embodiment.
Figure 16:
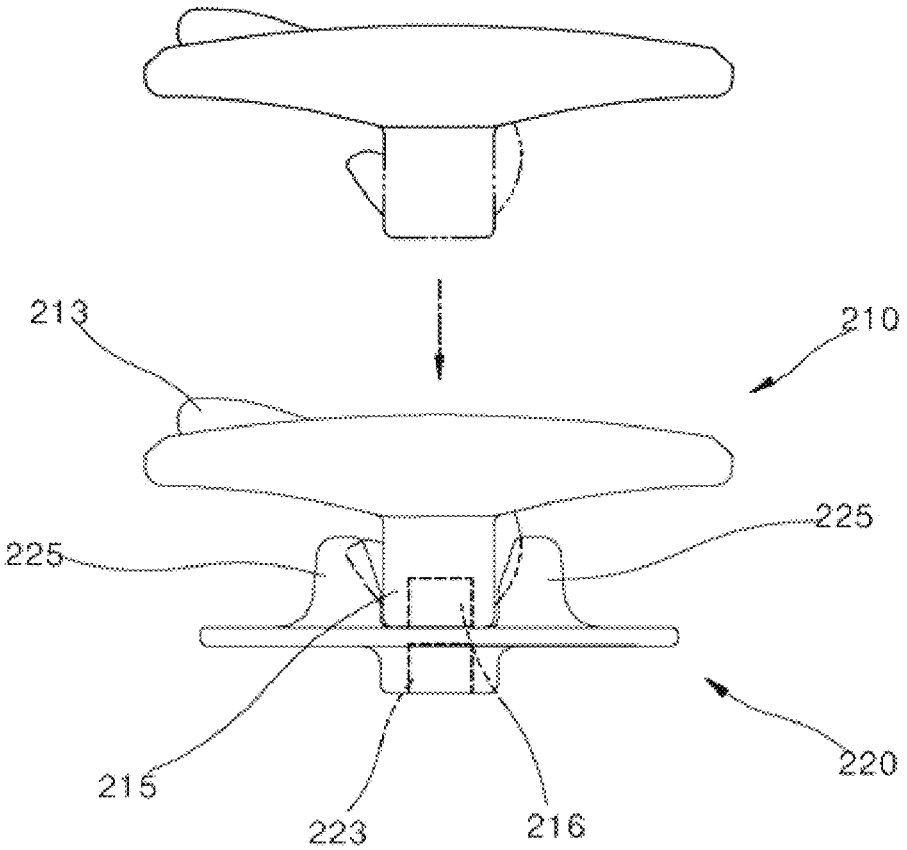
FIG. 16 is a lateral view illustrating a coupled state according to the second exemplary embodiment.
Figure 17:
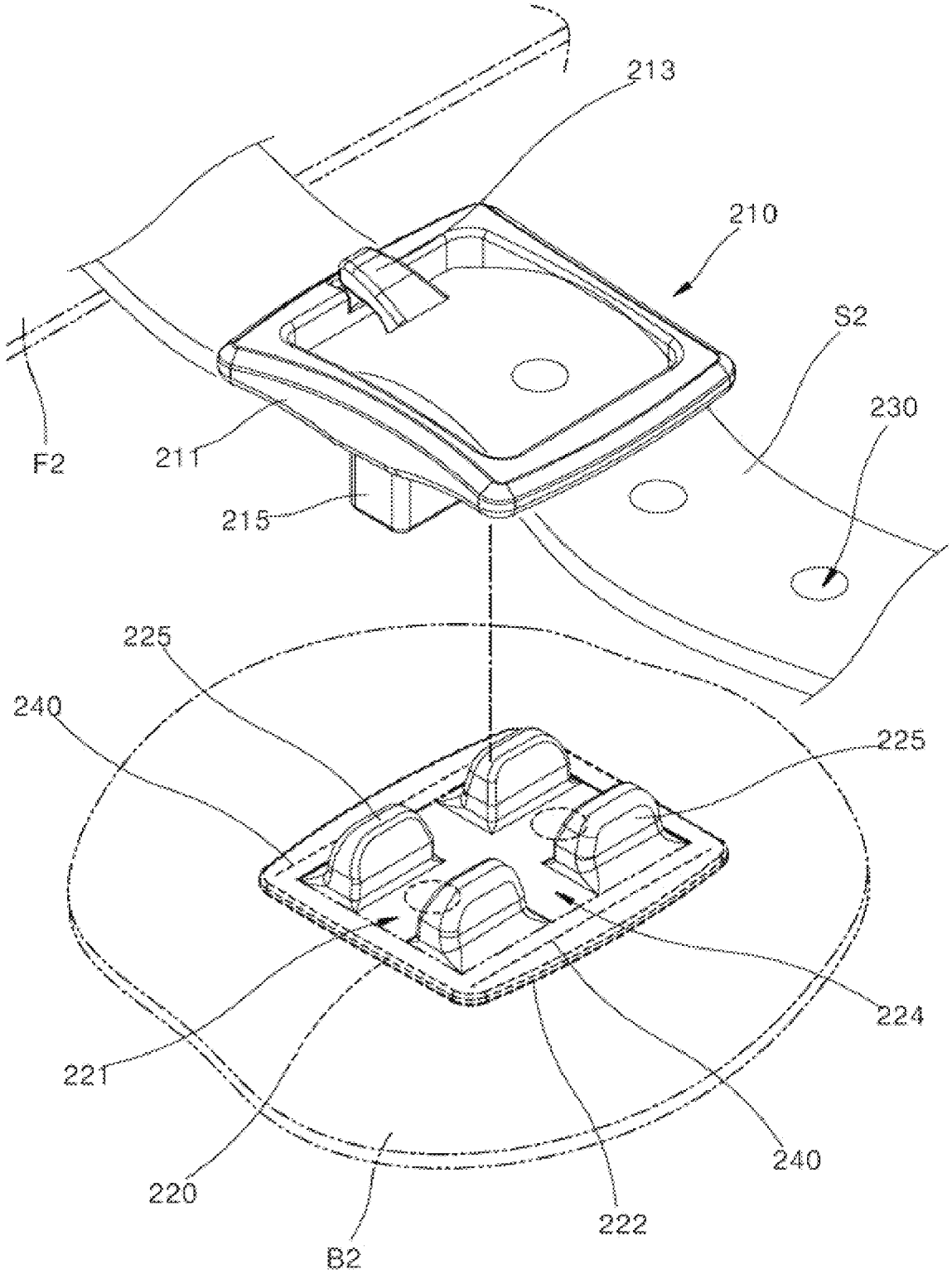
FIG. 17 is a view illustrating a state in which the buckle according to the second exemplary embodiment is installed and used.

FIG. 14 is an exploded perspective view of a buckle according to the second exemplary embodiment of the present disclosure, FIG. 15 is a bottom perspective view of a socket member, FIG. 16 is a lateral side view illustrating a coupled state of the buckle according to the present disclosure, and FIG. 17 is a view illustrating a state in which the buckle is installed and used. Similar to the first exemplary embodiment, a buckle 200 according to the present exemplary embodiment broadly includes a plug member 210 and a socket member 220.

The plug member 210 has the same configuration as the plug member 110 according to the first exemplary embodiment. The plug member 210 includes a frame 211 which has a loop shape, a cross bar 212 which traverses a lower intermediate side of the frame 211, and a hook 213 which is coupled to an intermediate portion of the cross bar 212.

A strap is interposed between the frame 211 and the cross bar 212. As illustrated in FIG. 14, a strap S2 enters the frame 211 from a lower side of the frame 211, travels over an upper side of the cross bar 212, and exits the frame 211 from an opposite lower side of the frame. Central portions of lateral portions of the frame 211 extend downward and the cross bar 212 is formed at lower ends of the central portions so that the strap may be smoothly interposed, and as a result, the cross bar 212 is positioned to further protrude downward in comparison with a circumferential edge portion of the frame 211.

Coupling protruding portions 215 are formed at both sides of the cross bar 212. The coupling protruding portion 215 may have a quadrangular cross section, and a first magnet 216 is embedded in a lower surface of the coupling protruding portion 215.

A recessed portion is formed in the intermediate portion of the cross bar 212 as the coupling protruding portions 215 are formed at both sides, and the hook 213 is installed in the recessed portion.

The hook 213 is fitted to be wound around the cross bar 212 so that the hook 213 is rotated about the cross bar 212. A tip portion of the hook 213 is elongated and inserted into a hole 230 formed in the strap S2, such that the hook 213 is fastened to the strap S2.

A catching projection 214 is formed at an intermediate portion of the hook 213. When the hook 213 is inserted into the hole 230 of the strap S2, the catching projection 214 prevents the tip portion of the hook 213 from excessively protruding while penetrating the strap S2.

The socket member 220 is formed in a thin plate shape. Four guide protruding portions 225 protrude from an upper surface of the socket member 220 so as to be spaced apart from one another, such that a coupling groove 221 is formed between the guide protruding portions 225.

A hook groove 224, which intersects, at a right angle, an intermediate portion of the coupling groove 221, is formed in the intermediate portion of the coupling groove 221, such that a "+" shaped groove is provided as a whole.

That is, the coupling groove 221 is formed as the surface of the socket member 220 protrudes.

The coupling protruding portions 215 of the plug member 210 are inserted into the coupling groove 221, and a second magnet 223 is embedded in a bottom surface of the coupling groove 221.

Further, the hook 213, which protrudes laterally, is accommodated in the hook groove 224 when the coupling protruding portions 215 of the plug member 210 are inserted.

As illustrated in FIG. 15, a portion in which the second magnet 223 is embedded protrudes from a bottom surface of the socket member 220.

As illustrated in FIG. 16, the plug member 210 and the socket member 220 remain coupled by magnetic force as the coupling protruding portions 215 of the plug member 210 are inserted into the coupling groove 221 of the socket member 220.

The socket member 220 is embedded at one end of a bag body B2. To this end, a circumferential edge portion of the upper surface of the socket member 220 is formed to have a flat surface and extends to form a wing portion 222. The wing portion 222 is attached to an outer sheath that defines the bag body B2.

As illustrated in FIG. 17, the wing portion 222 of the socket member 220 is coupled, by sewing, to the outer sheath of the bag body B2 in a state in which the guide protruding portions 225 and the coupling groove 221 are exposed. Alternatively, the wing portion 222 may be fixedly attached by a bonding agent. Reference numeral '240' indicates a sewed line.

The movements of the coupling protruding portions 215 are prevented as the hook 213, which further protrudes laterally than the coupling protruding portions 215, is coupled to the hook groove 224 when the coupling protruding portions 215 and the hook 213 are coupled. Further, the coupling protruding portions 215 are prevented from being withdrawn laterally from the coupling groove 221 opened laterally, thereby maintaining a more stably coupled state.

That is, when an unintentional action, such as external contact, of separating the buckle occurs, a drawback of the coupling groove 221 opened laterally is solved since the hook 213 is coupled to the hook groove 224 which extends while intersecting the intermediate portion of the coupling groove 221, thereby preventing abnormal withdrawal of the plug member 210.

In the present disclosure configured as described above, the socket member 220 is embedded at one end of the bag body B2, the strap S2 connected to the flap F2 is inserted into the frame 211 of the plug member 210, and the hook 213 is inserted into and connected to the hole 230.

The multiple holes 230 are formed at predetermined intervals in the strap S2, and as a result, it is possible to adjust a position of the plug member 210 by changing, as necessary, the position at which the hook 213 is coupled to the hole 230.

The buckle according to the present disclosure is coupled as the plug member 210 installed on the strap S2 is coupled directly to the socket member 220, and the coupling protruding portions 215 of the plug member 210 are strongly attached and coupled to the coupling groove 221 of the socket member 220 by magnetic force of the first and second magnets 216 and 223 while being inserted into the coupling groove 221 of the socket member 220.

The coupling protruding portions 215 of the plug member 210 are attracted and inserted into the coupling groove 221 by strong magnetic force of the first and second magnets 216 and 223 even when the plug member 210 approaches the vicinity of the socket member 220.

Here, an upper end portion of each of the guide protruding portions 225 may be formed to have a curved surface so that the coupling protruding portion 215 is smoothly inserted.

To separate the plug member 210 and the socket member 220, the buckle is separated as the coupling protruding portions 215 are withdrawn from the coupling groove 221 only by lifting up a free end of the strap S2 by applying small force, that is, force greater than attachment force of the first and second magnets 216 and 223.

As described above, the buckle is simply separated by lifting the plug member 210 directly upward with respect to the socket member 220 by using the tip portion of the strap S2. However, in a case in which pressure is applied in an abnormal direction, that is, in a lateral direction due to external contact, the plug member and the socket member are not easily separated in the directions other than the directly upward direction since the coupling protruding portions 215 and the hook 213 are in contact with the guide protruding portions 225 in all directions.

Figure 18:
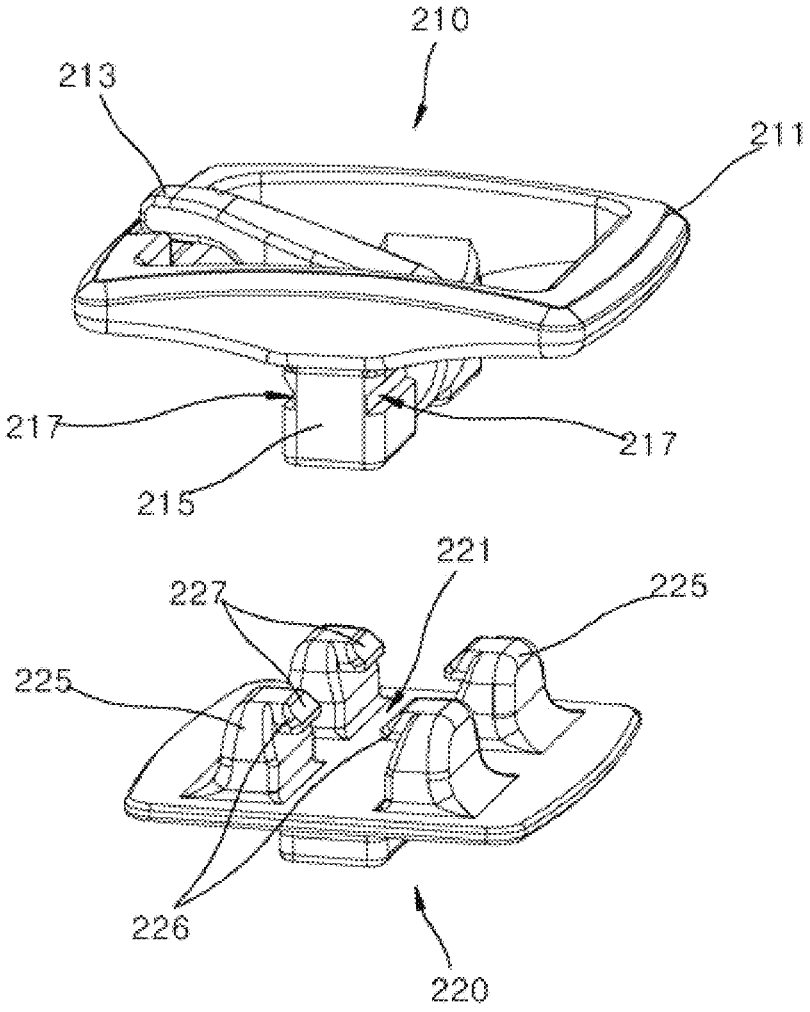
FIG. 18 is an exploded perspective view illustrating another type of the second exemplary embodiment.
Figure 19:
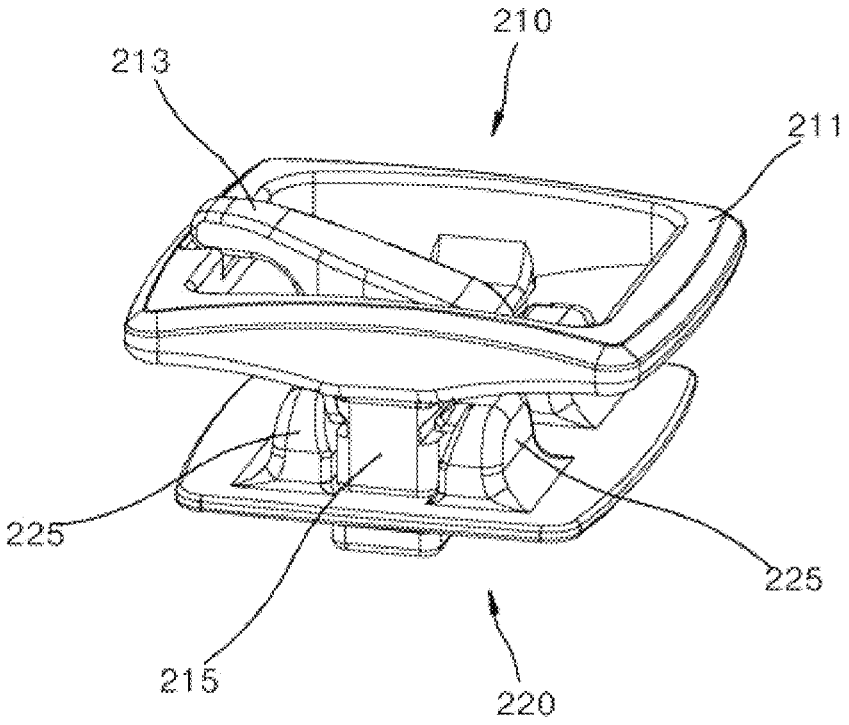
FIG. 19 is a perspective view illustrating a coupled state of FIG. 18.

FIG. 18 is an exploded perspective view illustrating a modified example of the buckle according to the present exemplary embodiment, and FIG. 19 is a coupled perspective view thereof. Referring to FIGS. 18 and 19, catching grooves 217 are formed in lateral surfaces of the coupling protruding portions 215 of the plug member 210, and catching protrusions 226 protrude, so as to face one another, from inner surfaces of the guide protruding portions 225 of the socket member 220 which face one another.

Therefore, when the coupling protruding portions 215 are inserted into the coupling groove 221, the catching protrusions 226 are caught by the catching grooves 217 of the coupling protruding portions 215 while the coupling protruding portions 115 are strongly inserted by magnetic force of the magnets, and as a result, the coupled state of the plug member 210 and the socket member 220 may be more securely maintained by magnetic force of the magnets.

An inclined surface 227 is formed on an upper surface of each of the catching protrusions 226 so that the coupling protruding portion 215 may be more easily inserted, and a curved or inclined surface may also be formed at an upper or lower end of the catching groove 217 so that the catching protrusion 226 is smoothly connected.

The coupling protruding portions 215 may be easily inserted into the coupling groove 221 by magnetic force while being guided by the inclined surfaces 227, and the plug member 210 may be separated from the socket member 220 by applying small force.

According to the exemplary embodiment of the present disclosure as described above, a stably coupled state of the plug member 210 and the socket member 220 may be maintained, and the intended separation may be conveniently performed.

The present disclosure described and illustrated above is not intended as being limited to the exemplary embodiments, and the present disclosure may be applied and modified in various forms without departing from the subject matter of the present disclosure. For example, according to the present disclosure, the shape of the coupling protruding portion, the shape of the coupling groove, and the number and shape of the guide protruding portion may be arbitrarily selected as necessary.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A bag comprising:

a bag body;

a flap which is configured to open and close an opening of the bag body and has a strap installed at a tip portion thereof; and a flap fixing buckle comprising:

a plug member having a cross bar that transverses an intermediate portion of a loop-shaped frame, wherein the strap is inserted into the plug member so as to be fixed by a hook or separated, and a coupling protruding portion in which a first magnet is embedded protrudes from the cross bar; and a socket member having a coupling groove into which the coupling protruding portion is inserted and which is formed in an upper surface of the socket member, wherein a second magnet is embedded inside the coupling groove, and a wing portion extends at a periphery of the upper surface of the socket member, such that the wing portion is fixedly attached to one end of the bag body.

2. The bag of claim 1, wherein catching grooves are formed in lateral surfaces of the coupling protruding portion, and multiple catching protrusions, which correspond to and are coupled to the catching grooves, are formed on a circumferential edge portion of the coupling groove so as to face one another.

3. A flap fixing buckle comprising:

a plug member having a cross bar that transverses an intermediate portion of a loop-shaped frame, wherein a coupling protruding portion in which a first magnet is embedded protrudes from the cross bar; and a socket member having a coupling groove into which the coupling protruding portion is inserted and which is formed in an upper surface of the socket member, wherein a second magnet is embedded inside the coupling groove.

4. The flap fixing buckle of claim 3, wherein catching grooves are formed in lateral surfaces of the coupling protruding portion, protruding portions protrude from a circumferential edge portion of the coupling groove so as to face one another, and catching protrusions are formed on lateral surfaces of the protruding portions which face one another, such that the catching protrusions are coupled to the catching grooves when the coupling protruding portion is inserted into the coupling groove.

5. The flap fixing buckle of claim 4, wherein an inclined surface is formed on an upper surface of the catching protrusion so that the coupling protruding portion is smoothly inserted.

6. The flap fixing buckle of claim 3, wherein a strap, which is installed on a flap of a bag and has holes formed at predetermined intervals, can be inserted into the frame, and a hook is rotatably coupled to an intermediate portion of the cross bar and configured to be inserted into one of the holes of the strap, such that the strap and the plug member can be coupled to each other, and the socket member is configured to be attached and installed at one end of a bag body in a state in which the socket member is embedded so that the coupling groove is exposed to outside, such that the plug member and the socket member are attached by magnetic force.

7. The flap fixing buckle of claim 6, wherein a circumferential edge portion of the socket member further extends outward to form a wing portion, such that the socket member can be easily attached to the bag body.

8. The flap fixing buckle of claim 6, wherein the socket member is configured to be coupled at one end of the bag body by sewing.

9. The flap fixing buckle of claim 3, wherein the frame is formed such that lower ends of an intermediate portion thereof, which face each other, protrude and extend downward, and the cross bar is formed on the protruding portions.

10. The flap fixing buckle of claim 3, wherein a hook groove is formed in an intermediate portion of the coupling groove so as to intersect the intermediate portion of the coupling groove, such that a hook is accommodated in the hook groove when the coupling protruding portion is coupled.

11. A flap fixing buckle comprising:

a plug member having a cross bar that transverses an intermediate portion of a loop-shaped frame, wherein a coupling protruding portion in which a first magnet is embedded protrudes from the cross bar; and a socket member having multiple guide protruding portions that protrude from an upper surface of the socket member such that a coupling groove into which the coupling protruding portion is inserted is formed between the guide protruding portions, wherein a second magnet is embedded inside the coupling groove.

12. The flap fixing buckle of claim 11, wherein four guide protruding portions are formed to face one another so that a "+" shaped groove is formed between the guide protruding portions.

13. The flap fixing buckle of claim 11, wherein catching grooves are formed in lateral surfaces of the coupling protruding portion, and catching protrusions protrude from inner surfaces of the guide protruding portions so as to face one another, such that the catching protrusions are coupled to the catching grooves when the coupling protruding portion is inserted into the coupling groove.

14. The flap fixing buckle of claim 13, wherein an inclined surface is formed on an upper surface of the catching protrusion so that the coupling protruding portion is smoothly inserted.

15. The flap fixing buckle of claim 11, wherein a strap, which is installed on a flap of a bag and has holes formed at predetermined intervals, can be inserted into the frame, and a hook is rotatably coupled to an intermediate portion of the cross bar and configured to be inserted into one of the holes of the strap, such that the strap and the plug member are configured to be coupled to each other, and the socket member is configured to be attached and installed at one end of a bag body in a state in which the socket member is embedded so that the coupling groove is exposed to outside, such that the plug member and the socket member are attached by magnetic force.

16. The flap fixing buckle of claim 11, wherein the frame is formed such that lower ends of the intermediate portion, which face each other, protrude and extend downward, and the cross bar is formed on the protruding portions.

17. The flap fixing buckle of claim 11, wherein a hook groove is formed in an intermediate portion of the coupling groove so as to intersect the intermediate portion of the coupling groove, such that a hook is accommodated in the hook groove when the coupling protruding portion is coupled.

* * * * *